US009028228B2

(12) United States Patent
Shepherd et al.

(10) Patent No.: US 9,028,228 B2
(45) Date of Patent: May 12, 2015

(54) PUMP

(75) Inventors: Paul David Shepherd, Hampton in Arden (GB); Magnus Cooper, Coventry (GB)

(73) Assignee: Concentric Birmingham Limited, Birmingham (GB)

( * ) Notice: Subject to any disclaimer, the term of this patent is extended or adjusted under 35 U.S.C. 154(b) by 907 days.

(21) Appl. No.: 13/072,514

(22) Filed: Mar. 25, 2011

(65) Prior Publication Data

US 2011/0232593 A1 Sep. 29, 2011

(30) Foreign Application Priority Data

Mar. 25, 2010 (GB) ..... 1005030.0

(51) Int. Cl.
*F04D 15/00* (2006.01)
*F04D 13/02* (2006.01)

(52) U.S. Cl.
CPC ..... *F04D 15/0027* (2013.01); *F04D 13/027* (2013.01)

(58) Field of Classification Search
CPC ..... F04D 13/027; F04D 15/0027
USPC ..... 417/319, 223
See application file for complete search history.

(56) References Cited

U.S. PATENT DOCUMENTS 6,007,303 A * 12/1999 Schmidt ..... 417/223
6,644,933 B2 * 11/2003 Light et al. ..... 417/223
6,915,887 B2 * 7/2005 Faller et al. ..... 192/48.2
7,144,225 B2 * 12/2006 Boffelli et al. ..... 417/223
7,475,764 B2 * 1/2009 Schultheiss et al. ..... 192/48.2
7,789,049 B2 * 9/2010 Duley ..... 123/41.47
8,079,828 B2 * 12/2011 Togawa et al. ..... 417/319
2009/0097996 A1 4/2009 Sakumoto

FOREIGN PATENT DOCUMENTS

GB EP2055910 5/2009
JP 2008138656 6/2008
JP 2009138545 6/2009

* cited by examiner

*Primary Examiner* — Christopher Bobish

(74) *Attorney, Agent, or Firm* — Cox Smith Matthews Incorporated

(57) ABSTRACT

A pump may include a rotatable pumping part, a drive shaft, and a coupling for transmitting rotational movement of the drive shaft to the pumping part. The coupling may include a first part which is connected to the pumping part and a second part which is connected to the drive shaft, the first part having an electrically conductive material and the second part having an element for generating a magnetic field. The second part may be moveable relative to the first part to vary the degree of interaction between a magnetic field generated by the element and the electrically conductive material. Movement of the second part relative to the first part may be caused, at least in part, by a fluid controlled actuator having a piston moveable within a cylinder which is substantially non-rotating, such that the drive shaft and the second part are rotatable relative to the cylinder.

13 Claims, 4 Drawing Sheets

PUMP

CROSS-REFERENCE TO RELATED APPLICATIONS

This application claims priority to GB Application No. 1005030.0 filed Mar. 25, 2010, the disclosure of which is herein incorporated by reference.

COPYRIGHT NOTICE

This application contains material that is subject to copyright protection. Such material may be reproduced exactly as it appears in Patent and Trademark Office patent files or records. The copyright owner otherwise reserves all rights to such material.

FIELD

This application generally relates to a pump, particularly but not exclusively to a pump for pumping coolant around an automotive engine.

BACKGROUND

Pumps for pumping coolant around automotive engines are typically mechanically driven via a direct mechanical connection with an output shaft of the engine which the pump is intended to cool. It will be appreciated that when a pump is driven in this way, there is a direct correlation between the speed of the engine and the speed of operation of the pump. However, it may be desirable to control the speed of the pump independently of the engine speed, and in order to do this, it is known to connect the pump to the engine output shaft via a magnetic coupling.

Such couplings generally include a part which includes a magnetic element and another part which includes an electrically conductive material, the two parts being moveable relative to one another. One part of the coupling is connected to and driven by an engine output shaft, for example, by a pulley, and the amount of torque transmitted from the engine output shaft to the pump depends upon the proximity of the magnetic element to the electrically conductive material. The greater the gap between the magnetic element and the conductive material, the smaller the proportion of engine output torque is transmitted to the pump.

It is known to actuate the relative movement of the two parts of such couplings mechanically for example by means of a lever. A challenge of such couplings is that a substantial distance in an axial direction of the coupling may be required between the two parts of the coupling and the connection to the engine output shaft, in order to accommodate the lever.

Furthermore, the actuator should not obstruct any part of the engine assembly.

The actuator (i.e. lever) is usually contained within a housing which should be sealed to avoid debris from entering the coupling. Providing a suitable and effective seal for sealing the housing can be problematic, as such seals are often awkward and vulnerable to damage.

SUMMARY

According to a first aspect of some embodiments of the invention, there is provided a pump including a pumping part which is mounted for rotation in a pumping chamber formed by a housing, rotation of the pumping part causing pumping of fluid within the pumping chamber, a drive shaft rotatable about a longitudinal axis, and a coupling for transmitting rotational movement of the drive shaft about its longitudinal axis to the pumping part, to cause the pumping part to rotate, the coupling including a first part which is connected to the pumping part and a second part which is connected to the drive shaft, the first part being provided with an electrically conductive material and the second part being provided with an element for generating a magnetic field, the second part being moveable relative to the first part of the coupling to vary the degree of interaction between a magnetic field generated by the element and the electrically conductive material, wherein movement of the second part of the coupling relative to the first part is caused, at least in part, by a fluid controlled actuator which includes a piston moveable within a cylinder which, in use, is substantially non-rotating, such that the drive shaft and the second part of the coupling, are rotatable relative to the cylinder.

The degree of interaction between a magnetic field generated by the element and the electrically conductive material may depend upon the size of a gap between the first part and the second part of the coupling. In some embodiments, an advantage of such a pump is that the flow of fluid to the actuator, and hence the position of the second part of the coupling relative to the first part, can be accurately controlled, by controlling the movement of the element for generating the magnetic field.

In some embodiments, the actuator may be a pneumatic actuator, and the piston may be a substantially annular piston moveable within a substantially annular cylinder. Both the cylinder and the piston may be centred on a longitudinal axis which extends along the drive shaft. This may improve the uniformity of the force applied by the actuating member to the second coupling part, so as to more accurately control the degree of interaction between the two coupling parts, and hence to more accurately control changes in the rate at which fluid is pumped by the pumping part.

In some embodiments, an advantage of providing a non-rotating cylinder is that there is no need to provide a rotary seal around the inlet/outlet of the cylinder.

Furthermore, the arrangement of the actuator in some embodiments of the present invention means that there is no obstruction of engine parts, and the actuator can easily be fitted in the space available between the coupling and the connection with the engine output shaft.

In some embodiments, the annular piston may include two substantially annular, co-axial plates with a connecting portion therebetween, such that the cross-section of the piston at one point on its circumference is substantially H-shaped. This construction accommodates pneumatic seals which seal the piston against an inner surface of the cylinder. The amount of material used in manufacturing such an actuating member is less than if a solid actuating member were provided.

In some embodiments, the actuating member and the second part of the coupling are moveable relative to the first part of the coupling in a direction substantially parallel to the longitudinal axis of the shaft. This ensures that a more even force is applied to the second part of the coupling. Thus a more even rate of change of the degree of interaction between the magnetic element and the electrically conductive material can be achieved as the two parts of the coupling move together or apart.

In some embodiments, the flow of pressurised air which controls the movement of the actuating member may be controlled by a valve. The valve may be a solenoid valve. The position of a valve member of the valve may be controlled by inputs received from an electronic control unit.

In some embodiments, the pneumatic actuator may be provided with compressed air by a pneumatic pump which also provides compressed air for an alternative system of an automotive vehicle. Where pressurised air is used to move the actuating member of the pump, a supply of pressurised air may already be available in an alternative application, e.g. for use in braking the vehicle. Thus the system is economical to implement, as some of the necessary components may already be present.

In some embodiments, the pumping part may be a rotary impeller.

In some embodiments, the first part of the coupling and the second part of the coupling may be separated from one another by a membrane. The membrane seals the "wet" part of the pump, i.e. the pumping part which includes the impeller, from the "dry" part of the pump, i.e. the part associated with the drive shaft. The magnetic coupling enables this sealing of the two sides of the pump without the need for complex rotary seals, by means of a relatively simple membrane. The membrane permits a magnetic field to pass therethrough and for magnetic induction between the first part of the coupling and the second part of the coupling to occur.

According to a second aspect of some embodiments of the invention, there is provided a cooling system for an automotive engine including a pump in accordance with the first aspect described above.

According to a third aspect of some embodiments of the invention, there is provided a pump including a pumping part which is mounted for rotation in a pumping chamber formed by a housing, rotation of the pumping part causing pumping of fluid, a drive shaft rotatable about a longitudinal axis, and a coupling for transmitting rotational movement of the drive shaft about its longitudinal axis to the pumping part, to cause the pumping part to rotate, the coupling including a first part which is connected to the pumping part and a second part which is connected to the drive shaft, the first part being provided with an electrically conductive material and the second part being provided with an element for generating a magnetic field, the second part being moveable relative to the first part of the coupling to vary the degree of interaction between a magnetic field generated by the element and the electrically conductive material, the pump also including a fluid controlled actuator for causing the movement of the second part of the coupling relative to the first part, the actuator including a piston moveable within a non-rotatable cylinder and there being a biasing mechanism for biasing the second part of the coupling towards the first part of the coupling, such that in the event of inoperation of the actuator, the second part of the coupling is urged towards the first part, so as to ensure an interaction between the magnetic field generated by the element and the electrically conductive material.

The biasing mechanism acts as a failsafe mechanism such that in the event of loss of air pressure or electrical power, the coupling is urged into a maximum torque transmission configuration, such that the maximum pumping rate is achieved and maintained. In known couplings which are actuated by electric motors, a transmission is usually provided to reduce speed and increase the torque available from the motor to move the actuator. In order to provide fail-safe operation, a passive return mechanism, for example a spring, may be provided to move the coupling into a high torque transmission configuration in the event of inoperation of the motor. In such an arrangement, the actuator may be capable of exerting a force which is sufficient to overcome the force of the passive return mechanism in addition to the force required to actuate the coupling.

Furthermore, in some embodiments, holding the two parts of the coupling at a constant distance from one another may require a constant supply of electrical power to prevent the actuator from returning to its "fail-safe" position under the influence of the passive return mechanism. Finally, the motor may be capable of being driven in reverse when idling, to enable the fail-safe mechanism to operate. All of these requirements may increase the size, cost and power consumption of a fail-safe coupling actuator. A fluid operated actuator may lend itself more naturally to fail-safe operation than an electrically operated actuator, since a compact pneumatic/hydraulic piston is capable of delivering substantial force throughout its stroke without needing a complex, back-driveable transmission. However, fail-safe pneumatic actuators may require a passage for admitting air to and receiving air from the cylinder. Known fail-safe actuators may include a conduit which is aligned with the axis of rotation of the coupling, which means that a rotary seal may be required, and also, the conduit and any hose or line connected to the conduit may be badly supported and vulnerable to damage.

In some embodiments, the second part of the coupling may be resiliently biased towards the first part of the coupling by a compression spring.

According to a fourth aspect of some embodiments of the invention, there is provided a cooling system for an automotive engine including a pump according to the third aspect of the invention.

BRIEF DESCRIPTION OF THE DRAWINGS

Certain embodiments of the invention will now be described, by way of example only, with reference to the accompanying drawings, of which.

DETAILED DESCRIPTION

Figure 1:
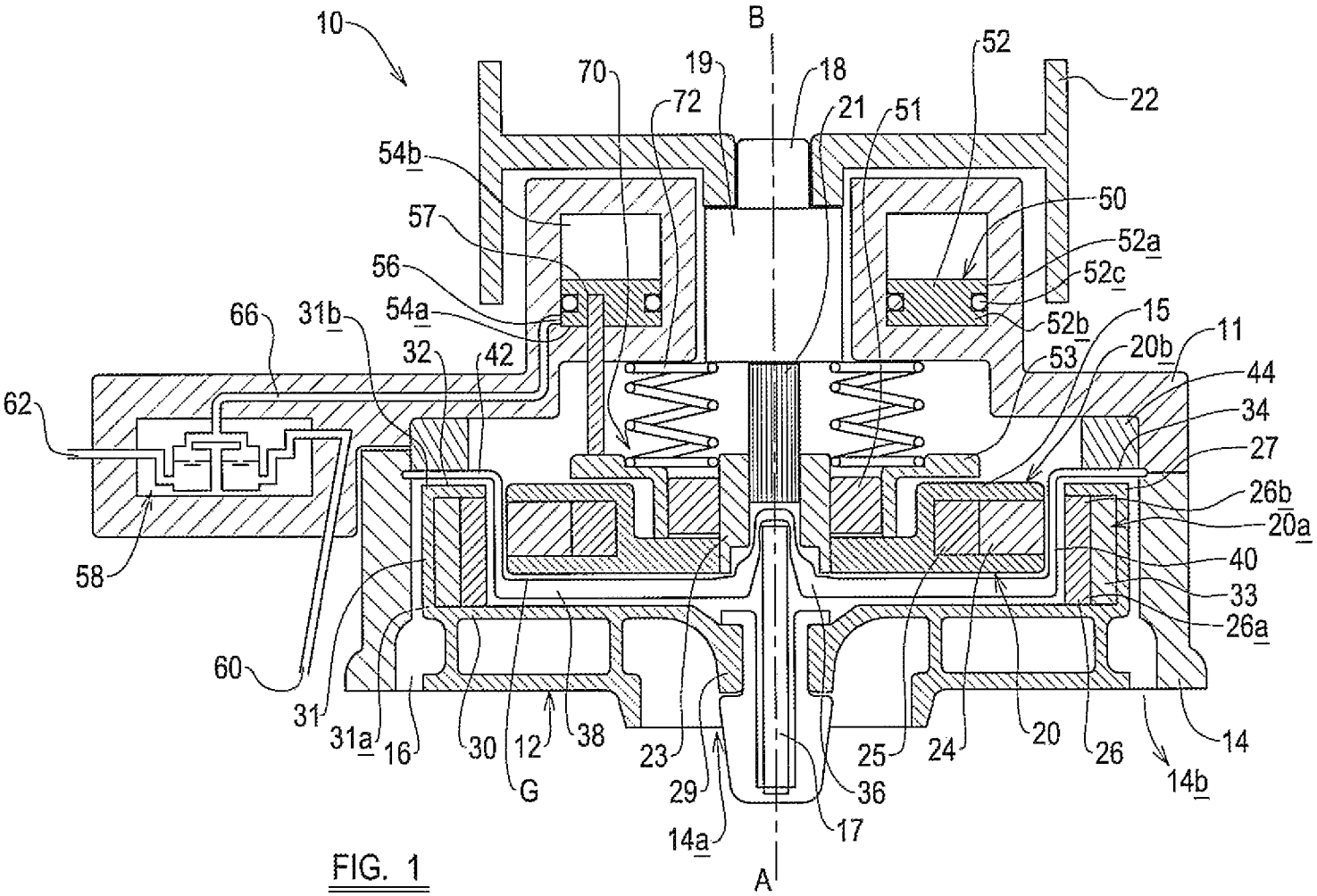
FIG. 1 is an illustrative cross-sectional view of a first embodiment of a pump, showing a coupling in a first, closed engaged configuration.
Figure 2:
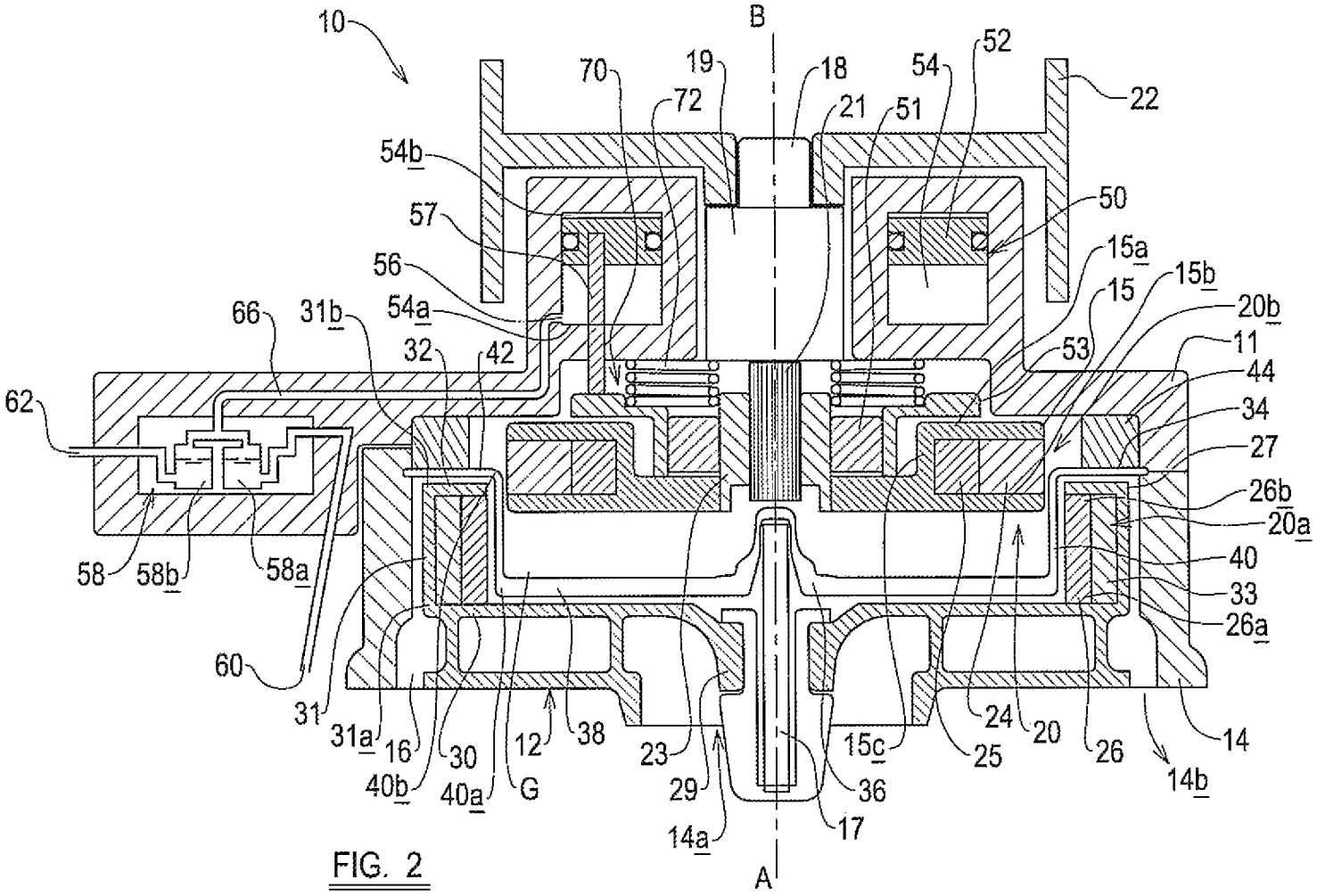
FIG. 2 is an illustrative cross-sectional view of the pump of FIG. 1, showing the coupling in a second, open, configuration.

Referring now to the drawings, there is shown a pump 10, including a main housing 11, and a pumping part 12, which in this example may be an impeller. The pumping part 12 may be mounted in a housing part 14 which may include a pumping chamber 16. The pumping part 12 may be mounted for rotation about an axis A on a support shaft 17, such that rotation of the pumping part 12 causes pumping of fluid within the pumping chamber 16, between an inlet 14*a* and an outlet 14*b*. Further features of the pumping part 12 may be conventional, and need not be discussed in detail. Rotation of the pumping part 12 may be caused by rotation of a drive shall 18 about an axis B, which may be substantially co-axial with the axis A of the support shaft 17.

The drive shaft 18 and the pumping part 12 may be coupled by a magnetic coupling 20 having a first part 20*a* which is associated with the pumping part 12, and a second part 20*b* which is associated with the drive shaft 18. The magnetic coupling 20 may be an eddy current coupling.

The second part 20*b* of the coupling 20 may be connected to the drive shaft 18 via a slider 21 and a boss 23. The slider 21 may be a substantially cylindrical rod which may be mounted on the drive shaft 18. An outer surface of the slider 21 may include a plurality of substantially longitudinal splines. The second part 20*b* of the magnetic coupling 20 may carry the boss 23. The boss 23 may be substantially cylindrical and may have an inner surface which includes a plurality of splines. The splines of the boss 23 may correspond with and may be engageable with the splines in the outer surface of the slider 21. The boss 23 may be slidable along the slider 21 in a direction which is substantially parallel with the axis B. Thus, the second part 20*b* of the coupling 20 may be moveable relative to the drive shaft 18 in a direction which is generally parallel with the axis B. However, the engagement of the splines of the boss 23 and the slider 21 may inhibit rotation of the second coupling part 20*b* relative to the drive shaft 18.

The second part 20*b* of the coupling 20 may include a substantially annular element 24 for generating a magnetic field. In this example, the element 24 may have a plurality of permanent magnets which form sectors of a generally annular array arranged about the rotational axis B of the drive shaft 18. The magnets of element 24 may be carried in a magnet carrier 15 which may include two axially spaced annular plates 15*a*, 15*b* which may be connected to one another by a connecting part 15*c*. The radial cross-section of the magnet carrier 15 may be substantially C-shaped.

The magnets of element 24 may be held in the magnet carrier 15, such that the magnets of element 24 may form sectors of a generally annular array arranged about the axis of rotation B of the drive shaft 18. The magnets of element 24 may be positioned radially outward relative to a backing ring 25. The backing ring 25 may act as a "keeper" for carrying magnetic fields efficiently between adjacent North and South poles of the magnets of element 24. The backing ring 25 may be manufactured from iron or very low carbon steel. The magnet carrier 15 may be connected to the boss 23, and the magnet carrier 15' and the magnets of element 24 may be moveable substantially axially along the drive shaft 18 along with the second part 20*b* of the coupling 20. It should be appreciated that the element for generating a magnetic field may also include a solenoid or coils of conductive wire to which an electrical current may be provided.

The first part 20*a* of the coupling 20 may be connected to and rotatable about the axis A with the pumping part 12. The first part 20*a* of the coupling 20 may be substantially annular. The first part 20*a* of the coupling 20 may be provided with an electrically conductive material 26. In this example, the electrically conductive material 26 may be a substantially annular induction ring manufactured from copper or other suitable material. The electrically conductive material 26 may be positioned radially outside the element 24, and may be carried by an induction ring carrier 27. The electrically conductive material 26 may have a first end 26*a* which is located towards the pumping part 12, and a second end 26*b*.

The induction ring carrier 27 may have a central collar 29, which may be connected to the support shaft 17, a substantially planar disk 30, which may extend generally radially outward from the collar 29, and a carrier wall 31 which may extend from a radially outer edge of the planar disk 30. The carrier wall 31 may have a first end 31*a* which may be connected to the planar disk 30, and a second end 31*b*. The induction ring carrier 27 may also have a return 32 which extends radially: inward towards the axes A and B from the second end 31*b* of the carrier wall 31.

The electrically conductive material 26 and a ferrous backing ring 33 may sit between the planar disk 30, the carrier wall 31 and the return 32. The electrically conductive material 26 may thus be connected to the pumping part 12. The axial positions of the pumping part 12 and the first part 20*a* of the coupling 20, including the electrically conductive material 26 and the induction ring carrier 27 may be generally fixed relative to the axes of rotation A and B, and hence to the main housing 11.

The first part 20*a* and the second part 20*b* of the coupling 20 may be separated by a gap G which may extend between the two parts 20*a*, 20*b* of the coupling 20. It will be appreciated that sliding movement of the second part 20*b* of the coupling 20 along the drive shaft 18 relative to the first part 20*a* of the coupling 20 may cause the width of the gap G to vary. The backing ring 33 may attract the magnet fields of the magnets of element 24 through the electrically conductive material 26 and guide them back towards an adjacent magnetic pole. This may improve the efficiency of the coupling 20. A coupling position sensor may be provided for sensing the relative positions of the first and second parts 20*a*, 120*a*, 20*b*, 120*b* of the coupling 20, 120. The coupling position sensor may be a rotary potentiometer, for example.

A membrane 34 may be positioned in the gap G and may separate the first coupling part 20*a* and the second coupling part 20*b*. The membrane 34 may provide a fluid-tight seal between the "wet" part of the pump 10, i.e. the part on the side of the pumping part 12, from the "dry" part of the pump 10, i.e. the part of the pump 10 on the side of the drive shaft 18. This ensures that fluid being pumped by the pumping part 12 may only be able to enter the pumping chamber 16 via the inlet 14*a* provided in the housing 14, and may exit the pumping chamber 16 via the outlet 14*b* provided in the housing 14. The membrane 34 may be manufactured from stainless steel or a plastics material, for example. In the latter case, the membrane 34 may be non-magnetisable and non-conducting.

The membrane 34 may be generally cylindrical, and may include a substantially hollow central boss part 36 in which the support shaft 17 may be received. A generally planar part 38 of the membrane 34 may extend outward from the central boss 36. A membrane wall 40 may extend from an outer radial edge of the generally planar part 38 in a substantially axial direction, away from the pumping part 12. The membrane wall 40 may have a first end 40*a*, which may be connected to the generally planar part 38, and a second end 40*b*. The membrane wall 40 may extend between the magnets of element 24 held in the magnet carrier 15 and the electrically conductive material 26, so as to separate the two. The depth of the membrane wall 40 may correspond approximately with the depth of the magnet carrier 15. An annular lip 42 may extend radially outward from the second end 40*b* of the membrane wall 40, adjacent the second end 26*b* of the electrically conductive material 26. The annular lip 42 may extend further radially outward than the electrically conductive material 26 and its carrier 27.

A membrane support ring 44 may support the membrane 34 in the housing 11. The membrane 34 may be fixed in position relative to the housing 11 and the pumping part 12.

An actuator 50 that may cause movement of the second part 20*b* of the coupling 20 relative to the first part 20*a* may be provided. The actuator 50 may include an actuating member 52 which may be a substantially annular piston, which may be mounted in a substantially annular cylinder 54 which may be defined by the housing 11.

The actuating member 52 may include a first generally annular plate 52*a* and a second generally annular plate 52*b*, which may be co-axial and connected to and spaced axially from one another by a connecting member 52*c*. Therefore, a cross-section through the actuating member 52 at a single point on the circumference may be generally H-shaped. One or more piston rods 57 may be connected between the second annular plate of the actuating member 52 and a substantially annular thrust plate 53 which may be connected to the boss 23, such that the thrust plate 53 may be moveable axially relative to the slider 21. The thrust plate 53 may be connected to the boss 23 via a thrust bearing 51. Thus, the actuator 50 may be connected to the second part 20*b* of the magnetic coupling 20, such that axial movement of the actuating member 52 causes axial movement of the second part 20*b* of the coupling 20, including the magnet carrier 15 and the magnets of element 24, as will be described in further detail below.

The cylinder 54 may include a first end 54*a* and a second end 54*b*, and may include a fluid inlet and outlet 56, which may be positioned towards the first end 54*a* of the cylinder 54. The flow of fluid, in this example compressed air, into and out of the inlet/outlet 56 may be controlled by a valve assembly 58 (shown schematically). The valve assembly may include a pair of two-port valves 58*a*, 58*b*. Inlet valve 58*a* may be a normally closed valve which may control the flow of fluid between an inlet 60 and the fluid inlet/outlet 56 of the cylinder 54. Outlet valve 58*b* may be a normally open valve which may control the flow of fluid between the fluid inlet/outlet 56 of the cylinder and an exhaust 62. The valve assembly 58 may be fluidly communicable with the fluid inlet/outlet 56 via a passage 66 in the housing 11.

In this example, the actuator 50 may be a pneumatic actuator, and thus the movement of the actuating member 52 may be controlled by the flow of compressed gas through the valve assembly 58. However, it will be appreciated that other types of fluid operated actuator, for example a hydraulic actuator using the flow of pressurised liquid, may also be used.

The valve assembly 58 may control the flow of compressed gas to and from the actuator 50 as follows:

| Inlet Valve 58a | | Exhaust valve 58b | | Function |
|---|---|---|---|---|
| Off | Closed | Off | Open | Engage coupling (also failsafe mode) |
| Off | Closed | On | Closed | Maintain current status |
| On | Open | On | Closed | Disengage coupling |
| On | Open | Off | Open | NOT USED |

The pump 10 may also include a fail-safe mechanism, in the form of a biasing mechanism 70. The biasing mechanism 70 may include at least one resilient biasing member in the form of a compression spring 72 which may be engageable with the housing 11. In this example, a plurality of compression springs 72 are provided, each of which abuts a part of the housing 11. Each compression spring 72 may also be connected to the second part 20*b* of the coupling 20, in particular, to the thrust plate 53, such that the second part 20*b* of the coupling may be biased towards the first part 20*a* of the coupling 20. Alternative arrangements are possible, for example the biasing mechanism 70 may include a single compression spring oriented in a generally axial direction. In the event of inoperation of the actuator 50, the second part 20*b* of the coupling 20 may be urged towards the first part 20*a*, as will be explained in more detail below.

Figure 3:
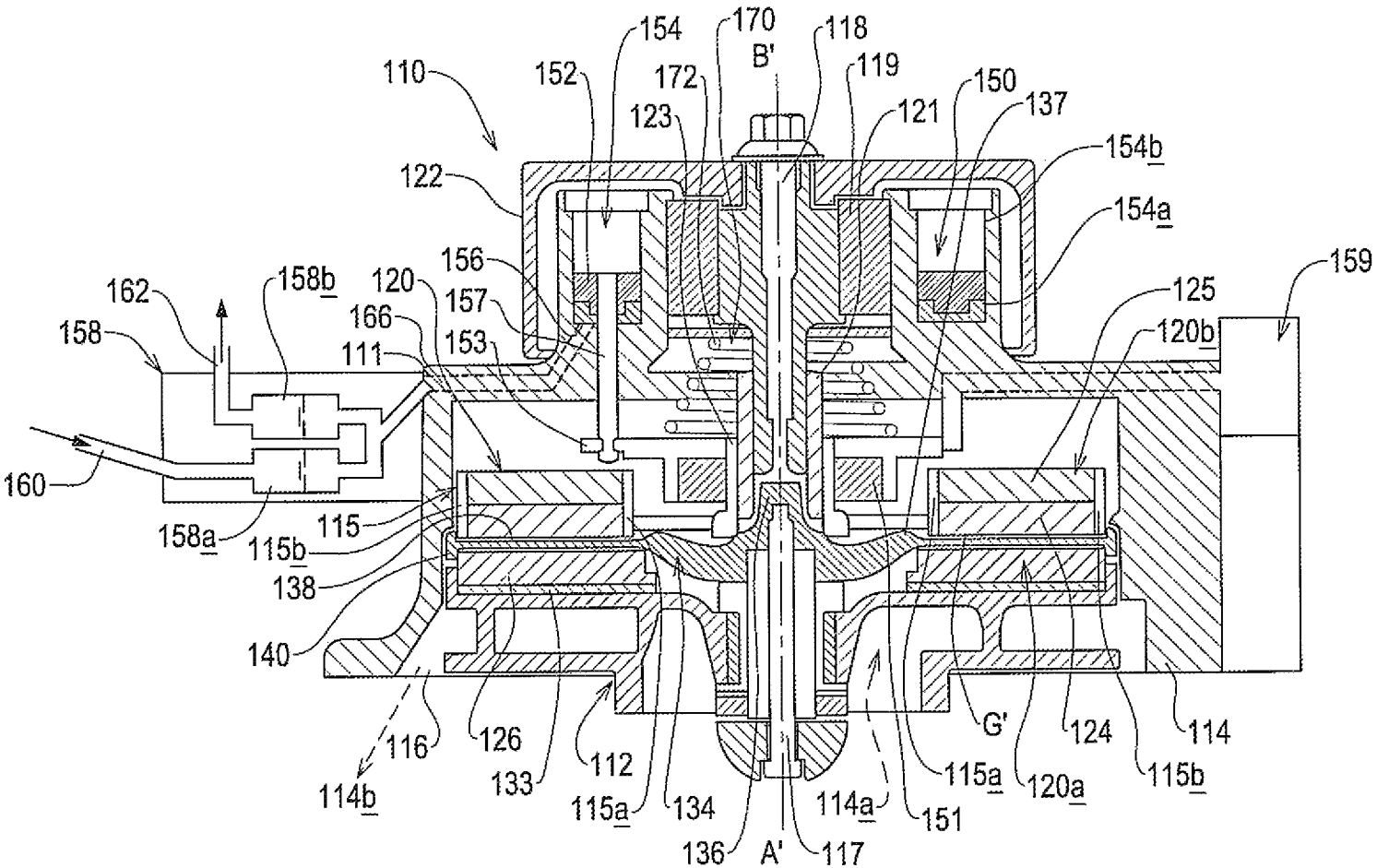
FIG. 3 is an illustrative cross-sectional view of a second embodiment of a pump, showing a coupling in a first, closed engaged configuration.
Figure 4:
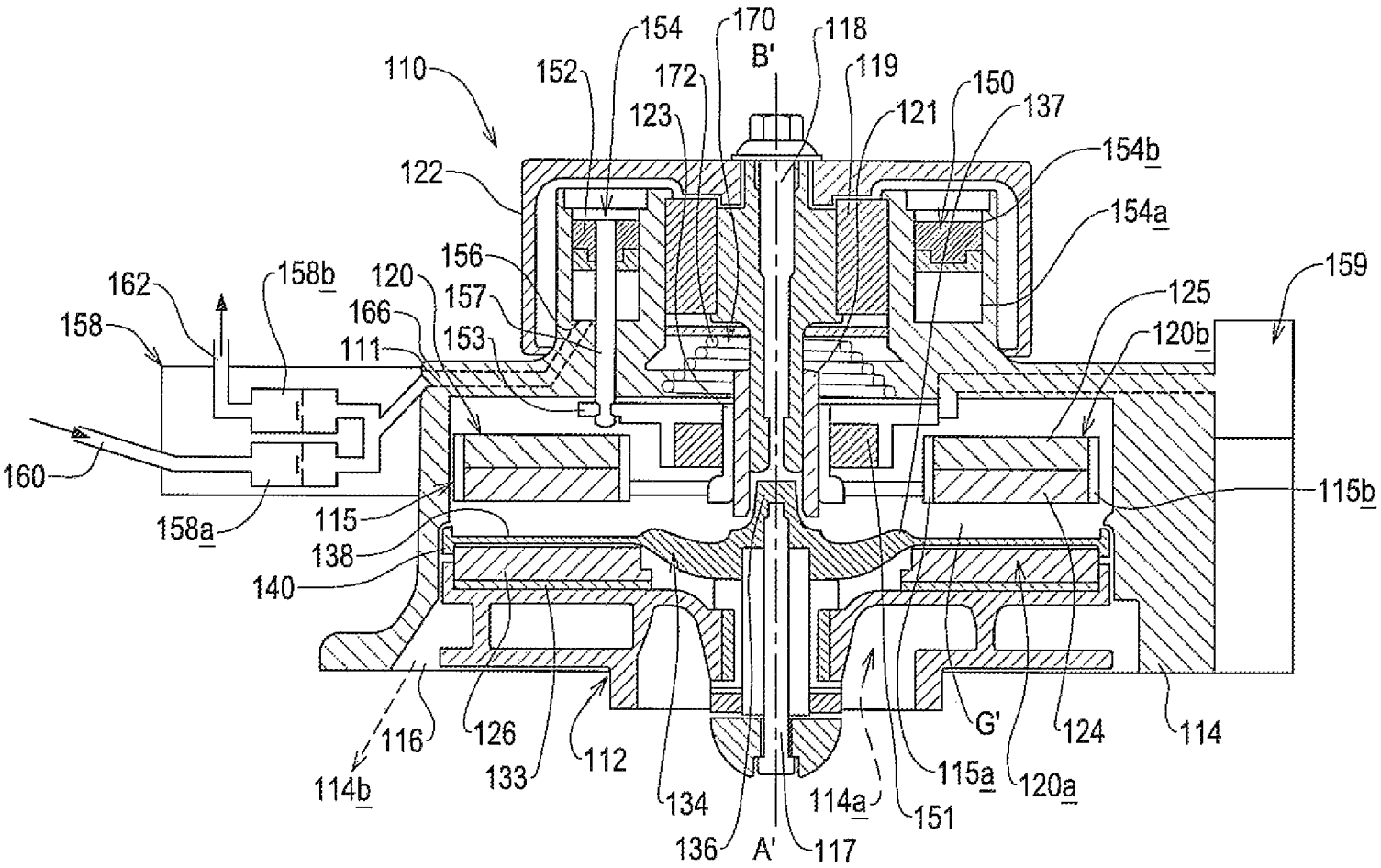
FIG. 4 is an illustrative cross-sectional view of the pump shown in FIG. 3, showing the coupling in a second, open configuration.

A second embodiment of the invention is shown in FIGS. 3 and 4. Features which correspond to features of the first embodiment of the invention are identified with corresponding reference numerals or letters prefixed by or suffixed with the "prime" symbol.

FIGS. 3 and 4 show a pump 110, including a main housing 111, and a pumping part 112, which, again, may be an impeller. The pumping part 112 may be mounted in a housing part 114 which may include a pumping chamber 116. The pumping part 112 may be mounted for rotation about an axis A' on a support shaft 117, such that rotation of the pumping part 112 may cause pumping of fluid within the pumping chamber 116, between an inlet 114*a* and an outlet 114*b*. Rotation of the pumping part 112 may be caused by rotation of a drive shaft 118 about an axis B', which may be substantially co-axial with the axis A' of the support shaft 117.

The drive shaft 118 and the pumping part 112 may be coupled by a magnetic coupling 120 having a first part 120*a* which may be associated with the pumping part 112, and a second part 120*b* which may be associated with the drive shaft 118. The magnetic coupling 120 may be an eddy current coupling.

The second part 120*b* of the coupling 20 may be connected to the drive shaft 118 via a slider 121 and a boss 123. The boss 123 may be slidable along the slider 121 in a direction which may be substantially parallel with the axis B'. Thus, the second part 120*b* of the coupling 120 may be moveable relative to the drive shaft 118 in a direction which is generally parallel with the axis B'. The slider 121 and the boss 123 may have corresponding longitudinal splines to inhibit rotation of the boss 123 relative to the slider 121, similar to those described in the first embodiment.

The second part 120*b* of the coupling 120 may include a substantially annular element 124 for generating a magnetic field. In this example, the element 124 may be a plurality of permanent magnets which form sectors of a generally annular array arranged about the rotational axis B' of the drive shaft 118. The magnets of element 124 may be carried in a magnet carrier 115 which may include a pair of concentric collars 115*a*, 115*b*.

The magnets of element 124 may be positioned co-axially relative to a backing ring 125. The backing ring 125 may act as a "keeper" for carrying magnetic fields efficiently between adjacent North and South poles of the magnets 124. In this embodiment, the magnetic fields emerging, from the magnets of element 124 may extend substantially axially. The backing ring 125 may be manufactured from iron or very low carbon steel or other suitable material. The magnet carrier 115 and the magnets of element 124 may be moveable substantially axially along, the drive shaft 118 with the second part 120*b* of the coupling 120. It should be appreciated that the element for generating a magnetic field may include a solenoid or coils of conductive wire to which an electrical current may be provided.

The first part 120*a* of the coupling 120 may be connected to and rotatable about the axis A' with the pumping part 112. The first part 120*a* of the coupling 120 may be substantially annular. The first part 120*a* of the coupling 120 may be provided with an electrically conductive material 126. In this example, the electrically conductive material 126 may be a substantially annular induction ring manufactured from copper or other suitable material. The electrically conductive material 126 may be substantially co-axial with the element 124.

The electrically conductive material 126 may be connected to the pumping part 112 via a ferrous backing ring 133 which may sit between the electrically conductive material 126 and the pumping part 112. The axial positions of the pumping part 112 and the first part 120*a* of the coupling 120, which may include the electrically conductive material 126, may be generally fixed relative to the axes of rotation A' and B', and hence to the main housing 111.

The first part 120*a* and the second part 120*b* of the coupling 120 may be separated by a gap G' which may extend between the two parts 120*a*, 1206 of the coupling 120. It will be appreciated that sliding movement of the second part 120*b* of the coupling 120 along the drive shall 118 relative to the first part 120*a* of the coupling 120 may cause the width of the gap G' to vary. The backing ring 133 may attract the magnetic fields of the magnets of element 124 through the electrically conductive material 126 and guide them back towards an adjacent magnetic pole. A coupling position sensor 159 may sense the relative positions of the first and second parts 120*a*, 120*b* of the coupling 120. The coupling position sensor 159 may be a rotary potentiometer.

A membrane 134 may be positioned in the gap G' and may separate the first coupling part 120*a* and the second coupling part 120*b*. The membrane 134 may provide a fluid-tight seal between the "wet" part of the pump 110, i.e. the part on the side of the pumping part 112, from the "dry" part of the pump 110, i.e. the part of the pump 110 on the side of the drive shaft 118. This ensures that fluid being pumped by the pumping part 112 may only be able to enter the pumping chamber 116 via the inlet 114*a* provided in the housing 114, and may exit the pumping chamber 116 via the outlet 114*b* provided in the housing 114. The membrane 134 may be manufactured from stainless steel or a plastics material, for example. In the latter case, the membrane 134 may be non-magnetisable and non-conducting.

The membrane 134 may be generally disk-shaped, and may include a hollow central boss part 136 in which the support shaft 117 may be received. A generally concave portion 137 of the membrane may extend radially outward from the central boss part 136, and a substantially planar part 138 may extend outward from the generally concave portion 137. A circumferential lip 140 may extend in a substantially axial direction around an outer edge of the substantially planar part 138. The substantially planar part 138 of the membrane 134 may extend between the magnets of element 124 held in the magnet carrier 115 and the electrically conductive material 126, so as to separate the two. The substantially planar part 138 may be substantially frustoconical.

An actuator 150 that may cause movement of the second part 120*b* of the coupling 120 relative to the first part 120*a*, may be provided. The actuator 150 may include an actuating member 152 which may be a substantially annular piston, which may be mounted in a substantially annular cylinder 154 which may be defined by the housing 111.

One or more piston rods 157 may be connected between the actuating member 152 and a substantially annular thrust plate 153. The thrust plate 153 may be connected to the boss 123 such that the thrust plate 153 may be moveable axially relative to the slider 121. The thrust plate 153 may be connected to the boss 123 via a thrust bearing 151. Thus, the actuator 150 may be connected to the second part 120*b* of the magnetic coupling 120, such that axial movement of the actuating member 152 may cause axial movement of the second part 120*b* of the coupling 120*b*, including the magnet carrier 115 and the magnets 124, as will be described in further detail below.

The cylinder 154 may include a first end 154*a* and a second end 154*b*, and may include a fluid inlet and outlet 156, positioned towards the first end 154*a* of the cylinder 154. The flow of fluid, in this example compressed air, into and out of the inlet/outlet 156 may be controlled by a valve assembly 158 (shown schematically). The valve assembly may include a pair of two-port valves 158*a*, 158*b* which may be fluidly communicable with the inlet/outlet 56 via a passage 166 in the housing 111. Inlet valve 158*a* may be a normally closed valve and may control the flow of fluid between an inlet 160 and the fluid inlet/outlet 156 of the cylinder 154. Outlet valve 158*b* may be a normally open valve and may control the flow of fluid between the fluid inlet/outlet 156 of the cylinder and an exhaust 162. The valve assembly 158 may operate in the same way as the valve assembly 58 of the first embodiment of the invention.

In this example, the actuator 150 may be a pneumatic actuator, and thus the movement of the actuating member 152 may be controlled by the flow of compressed gas through the valve assembly 158. However, it will be appreciated that other types of fluid operated actuator, for example a hydraulic actuator using the flow of pressurised liquid, may also be used.

The pump 110 may also include a fail-safe mechanism in the form of a biasing mechanism 170, which may include at least one resilient biasing member in the form of a compression spring 172 which may be connected to the housing 111 via a plate which may be fixed relative to the housing 111 and to the second part 120*b* of the coupling 120, in a similar fashion to the compression spring 72 of the first embodiment. The second part 120*b* of the coupling 120 may be biased towards the first part 120*a* of the coupling 120 by the compression spring 172. In the event of inoperation of the actuator 150, the second part 120*b* of the coupling 120 may be urged towards the first part 120*a*, as will be explained in more detail below.

In use, the pump 10, 110 may be incorporated into a cooling system for an internal combustion engine, for example an automotive engine, to pump coolant fluid around the engine. The cooling system may also include a heat exchanger for reducing the temperature of coolant fluid which has been heated whilst being pumped around the engine. In this case, the drive shaft 18, 118 may be connected for rotation with a pulley 22, 122 which may be driven by an output shaft of an automotive engine. A pulley bearing 19, 119 may facilitate the pulley 22, 122 and the drive shaft 18, 118 to rotate relative to the pump housing 11, 111. The pulley 22, 122 and the drive shaft 18, 118 may preferably be substantially co-axial.

At least one temperature sensor may be provided in the engine, and the or each sensor may be connected to an ECU (electronic control unit) which may receive inputs from the or each sensor which represent the temperature of the engine. The valve assembly 58, 158 may be connected to the ECU so that the ECU may control operation of the valve assembly in accordance with the temperature of the engine, as mentioned above. It will be appreciated that the ECU may additionally or alternatively control the operation of the valve assembly 58, 158 in accordance with other parameters of the engine. For example, the ECU may receive inputs relating to the rate of fuel consumption, such as pedal position or engine speed. Including additional inputs to the ECU may enable the coupling 20, 120 to respond more quickly to changing conditions. Vehicle testing may be carried out to determine the most appropriate input or combination of inputs to be used.

The proximity of the magnets 24, 124 of the second part 20*b*, 120*b* of the coupling 20, 120 to the electrically conductive material 26, 126 in the first part 20*a*, 120*a* of the coupling 20, 120, may ensure that relative movement between the magnets 24, 124 and the electrically conductive material 26, 126 cause an eddy current to be induced in the electrically conductive material 26, 126. The eddy current may produce a magnetic field which may interact with the magnetic field produced by the magnets 24, 124, and may produce a force which acts on the magnets 24, 124, and hence produces a torque, which acts to reduce the difference in speed between the two parts 20*a*, 120*a*, 20*b*, 120*b* of the coupling 20, 120.

The magnitude of the torque produced by the degree of interaction of the magnetic fields may depend on the size of the gap G, G', i.e. on the proximity of the two parts 20*a*, 120*a*, 20*b*, 120*b* of the coupling 20, 120. The closer the two parts 20*a*, 120*a*, 20*b*, 120*b* of the coupling 20, 120 are to one another, the greater the degree of magnetic interaction between the two parts 20*a*, 120*a*, 20*b*, 120*b* of the coupling 20, 120, and hence the greater the proportion of the torque transmitted from the drive shaft 18, 118 to the pumping part 12, 112. As a result, if the drive shaft 18, 118 is rotating at a constant speed, the speed of rotation of the pumping part 12, 112 may be varied by varying the width of the gap G, G'. Increasing the size of the gap G, G' may reduce the speed of rotation of the pumping part 12, 112, and decreasing the size of the gap G, G' may increase the rotational speed of the pumping part 12, 112. The rate at which fluid is pumped by the pumping part 12, 112 from the inlet of the pumping chamber 16, 116 to the outlet of the pumping chamber 16, 116 may depend upon the speed of rotation of the pumping part 12, 112. By virtue of using such a magnetic coupling 20, 120, no mechanical connection is required between the pumping part 12, 112 and the drive shaft 18, 118, and the pumping chamber 16, 116 can be sealed without the need for a rotary seal.

The size of the gap G, G' may be varied by movement of the second part 20*b*, 120*b* of the coupling 20, 120 axially along the drive shaft 18, 118, relative to the first part 20*a*, 120*a* of the coupling 20, 120. This movement may be caused by the actuator 50, 150, which may be operated by the valve assembly 58, 158.

The ECU may provide signals to the valve assembly 58, 158 which correspond to the required actuation of the coupling (20, 120), for example "engage", "hold" or "disengage". The ECU may calculate the desired actuation based on inputs from sensors, for example one or more temperature sensors and/or a coupling position sensor. The ECU may determine a desired rate of pumping which may be required to achieve the desired temperature of the automotive engine. The desired pumping rate may have an associated gap G, G'. The size of the gap G, G' may depend upon the position of the actuating member 52, 152 relative to the cylinder 54, 154. The ECU may use a lookup table or similar arrangement to determine the desired rate of pumping and/or the size of the associated gap G, G' and/or the necessary position of the actuating member 52, 152 relative to the cylinder 54, 154.

As mentioned above, the cooling system may include at least one sensor for detecting the positions of the first and second parts 20*a*, 120*a*, 20*b*, 120*b* of the coupling 20, 120 relative to one another. The sensor may be a position feedback sensor. The ECU may receive one or more inputs relating to the position of the actuating member 52, 152 relative to the cylinder 54, 154 from the sensor, which gives an indication of the size of the current gap G, G'. The inputs to the ECU may additionally or alternatively be provided by a Hall-effect sensor. Alternatively, an input relating to the speed of the pumping part 12, 112 or the output flow of the pump 10, 110 could be provided to the ECU to assist in the control of the operation of the pump 10, 110 in accordance with desired and existing conditions. The ECU may compare the desired gap G, G' with the current gap G, G' to determine the operation of the pump 10, 110.

In the event that the engine temperature is higher than desired, it may be necessary to increase the rate of pumping by the pumping part 12, 112, so as to maintain the engine temperature within an acceptable range. Hence, the gap G, G' may need to be reduced, so as to increase the amount of torque transfer between the drive shaft 18, 118 and the pumping part 12, 112. The ECU may send a control signal to the valve 58, 158, causing the valve 58, 158 to adopt a position such that air can be vented from the cylinder 54, 154, through the outlet 56, 156, through the passage 66, 166, and out of the exhaust 62, 162. Venting the cylinder 54, 154 may enable the springs 72, 172 to push the thrust plate 53, 153 and the second part 20*b*, 120*b*, of the coupling 20, 120, to which the thrust plate 53, 153 is connected, in an axial direction towards the first part 20*a*, 120*a* of the coupling 20, 120. The thrust plate 53, 153 may be connected to the piston rod(s) 57, 157, and therefore the actuating member 52, 152 may move towards the first end 54*a*, 154*a* of the cylinder 54, 154. This may decrease the size of the gap G, G', which may increase the torque transfer between the drive shaft 18, 118 and the pumping part 12, 112, i.e. reducing the amount of slip between the drive shaft 18, 118 and the pumping part 12, 112, which may increase the speed of rotation of the pumping part 12, 112. As the speed of rotation of the pumping part 12, 112 increases, the rate at which coolant may be pumped around the engine and through the heat exchanger may increase, which may cool the engine more, so that the temperature of the engine may decrease. The maximum speed of rotation of the pumping part 12, 112, and thus maximum cooling, may be achieved when the induction clutch is fully engaged, i.e. when the size of the gap G, G' is at a minimum. In the first embodiment of the invention, this may correspond to the magnets of element 24 being fully aligned with the electrically conductive material 26.

In the event that the engine temperature is lower than desired, it may be advantageous to decrease the rate of pumping by the pumping part 12, 112. Hence, the gap G may need to be increased. The ECU may send a control signal to the valve assembly 58, 158, causing the valve assembly 58, 158 to adopt a configuration such that compressed air can be let into the valve assembly 58, 158 via the inlet 60, 160. The air may then be permitted to enter the cylinder 54, 154 via the passage 66, 166 and the inlet 56, 156. Air entering the cylinder 54, 154 via the inlet 56, 156 may cause the actuating member 52, 152 to move towards the second end 54*b*, 154*b* of the cylinder 54, 154. This movement of the actuating member 52, 152 may cause corresponding movement of the piston rod(s) 57, 157, and hence the second part 20*b*, 120*b* of the coupling 20, 120 via the thrust plate 53, 153 in a generally axial direction, away from the first part 20*a*, 120*a* of the coupling 20, 120. This may increase the size of the gap G, G' between the first part 20*a*, 120*a* and the second part 20*b*, 120*b* of the coupling 20, 120 and thus reduce the torque transfer between the drive shall 18 and the pumping part 12, 112, i.e. the amount of slip permitted between the drive shaft 18, 118 and the pumping part 12, 112 increases, which reduces the speed of rotation of the pumping part 12, 112. The minimum speed of the pumping part 12, 112 (which may be zero rpm) may be achieved when the induction clutch 20, 120 may be fully disengaged, such that the gap G, G' is a maximum, which corresponds to the actuating member 52, 152 being positioned at the second end 54*b*, 154*b* of the cylinder 54, 154. In the first embodiment of the invention, this may correspond to no part of the magnets of element 24 being aligned with the electrically conductive material 26.

In the event that the rate of pumping is determined to be as desired, no adjustment of the induction clutch may be required, and hence the relative positions of the first and second parts 20*a*, 120*a*, 20*b*, 120*b* of the coupling 20, 120 may be maintained. To this end, the ECU may provide the valve assembly 58, 158 with a control signal such that the valve assembly 58, 158 maintains its current configuration, thus maintaining the flow of air through the valve, so as to maintain the same pressure in the cylinder 54, 154. Thus the actuating member 52, 152 may remain substantially stationary relative to the cylinder 54, 154, and the size of the gap G, G' may not alter. Thus the amount of torque transferred from the drive shaft 18, 118 to the pumping part 12, 112 may remain substantially constant.

As an alternative to this method of operation, an ECU which is associated with the pump 10, 110, may be provided in addition to an engine ECU. The main ECU of the engine may be used to calculate the required gap G, G' based on engine temperature and/or fuel burn rate and transmit a signal corresponding to the required gap G, G' to the ECU associated with the pump 10, 110 which may compare the required gap G, G' with the present (sensed) gap G, G', and may provide a signal to the valve assembly 58, 158 corresponding to the actuation necessary to obtain the required gap, G, G'.

The biasing mechanism 70, 170 may operate in the event of inoperation of the actuator 50, 150, and hence is a failsafe mechanism. The default position for the valve assembly 58, 158 may be for the inlet valve 58*a*, 158*a* to be closed, and may be for the outlet valve 58, 158*b* to be open, to vent air through the exhaust 62, 162. The compression spring 72, 172 may push the thrust plate 53, 153 and the second part 20*b*, 120*b* of the coupling 20, 120, to which the thrust plate 53, 153 may be connected, in an axial direction towards the first part 20*a*, 120*a* of the coupling 20, 120. The thrust plate 53, 153 may be connected to the piston rod(s) 57, 157 and therefore the actuating member 52, 152 may move towards the first end 54*a*, 154*a* of the cylinder 54, 154. As such, the actuating member 52, 152 may be biased towards the first end 54*a*, 154*a* of the cylinder 54, 154 and the second part 20*b*, 120*b* of the coupling 20, 120 may be biased towards being fully engaged with the first part of the coupling 20, 120. Thus the transmission of torque from the drive shaft 18, 118 to the pumping part 12, 112 may be maintained at a maximum in the event of the loss of air pressure or electrical supply. Therefore, the maximum pumping rate may be maintained in the event of the loss of air pressure or electrical supply.

It will be appreciated that such a failsafe mechanism 70, 170 may be adapted for use with other couplings which operate on a similar basis, but which, perhaps, operate in reverse, i.e. wherein the pumping part moves relative to the housing, and the drive shaft and the element for generating a magnetic field remains generally stationary.

As an alternative to the pair of valves 58*a*, 58*b*, the valve assembly 58, 158 may include an electronically controlled, three-port, three-position valve, for example a solenoid valve. The position of a valve member of such a valve may be controlled by signals from an ECU. Such a valve may have an inlet, an exhaust, and a controlled port which is fluidly communicable with the inlet/outlet 56, 156 of the cylinder 54, 154 via the passage 66, 166 in the housing 11, 111.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

Although the present invention and some of its advantages have been described in detail, it should be understood that various changes, substitutions and alterations can be made herein without departing from the invention as defined by the appended claims and further claims that may be drawn on this disclosure. Moreover, the scope of the present application is not intended to be limited to the particular embodiments of the process, machine, manufacture, composition, or matter, means, methods and steps described in the specification. Among other things, any feature described in connection with one embodiment may be used in connection with any other embodiment. As a person of ordinary skill in the art will readily appreciate from this disclosure, other processes, machines, articles of manufacture, compositions of matter, means, methods, or steps, presently existing or later to be developed, that perform substantially the same function or achieve substantially the same result as the corresponding embodiments described herein may be utilized. Accordingly, the appended claims and further claims that may be drawn on this disclosure are intended to include within their scope such processes, machines, articles of manufacture, compositions of matter, means, methods or steps and equivalents.

What is claimed is:

1. A pump comprising:

a pumping part which is mounted for rotation in a pumping chamber formed by a housing, rotation of the pumping part causing pumping of fluid within the pumping chamber;

a drive shaft rotatable about a longitudinal axis; and a coupling to transmit rotational movement of the drive shaft about its longitudinal axis to the pumping part, to cause the pumping part to rotate, the coupling comprising a first part which is connected to the pumping part and a second part which is connected to the drive shaft;

the first part being provided with an electrically conductive material and the second part being provided with an element for generating a magnetic field;

the second part being moveable relative to the first part to vary a degree of interaction between a magnetic field generated by the element and the electrically conductive material;

wherein movement of the second part relative to the first part is caused, at least in part, by a fluid controlled actuator which comprises a piston moveable within a cylinder which, in use, is substantially non-rotating, such that the drive shaft and the second part are rotatable relative to the cylinder.

2. A pump according to claim 1 wherein the degree of interaction between the magnetic field generated by the element and the electrically conductive material depends upon the size of a gap between the first part and the second part.

3. A pump according to claim 1 wherein the fluid controlled actuator comprises a pneumatic actuator.

4. A pump according to claim 1 wherein the piston comprises a substantially annular piston moveable within a substantially annular cylinder.

5. A pump according to claim 1 wherein the fluid controlled actuator and the second part are moveable relative to the first part in a direction substantially parallel to the longitudinal axis of the drive shaft.

6. A pump according to claim 3 wherein a flow of pressurised air which controls movement of the actuator is controlled by a valve.

7. A pump according to claim 3 wherein the pneumatic actuator is provided with compressed air by a pneumatic pump which also provides compressed air for an alternative system of an automotive vehicle.

8. A pump according to claim 1 wherein the pumping part comprises, a rotary impeller.

9. A pump according to claim 1 wherein the first part and the second part are separated from one another by a membrane.

10. A cooling system for an automotive engine comprising:

a pump Comprising a pumping part which is mounted for rotation in a pumping chamber formed by a housing, rotation of the pumping part causing pumping of fluid within the pumping chamber;

a drive shaft rotatable about a longitudinal axis; and a coupling to transmit rotational movement of the drive shaft about its longitudinal axis to the pumping part, to cause the pumping part to rotate, the coupling comprising a first part which is connected to the pumping part and a second part which is connected to the drive shaft, the first part being provided with an electrically conductive material and the second part being provided with an element for generating a magnetic field, the second part being moveable relative to the first part to vary a degree of interaction between a magnetic field generated by the element and the electrically conductive material;

wherein movement of the second part relative to the first part is caused, at least in part, by a fluid controlled actuator which includes a piston moveable within a cylinder which, in use, is substantially non-rotating, such that the drive shaft and the second part are rotatable relative to the cylinder.

11. A pump comprising:

a pumping part which is mounted for rotation in a pumping chamber formed by a housing, rotation of the pumping part causing pumping of fluid;

a drive shaft rotatable about a longitudinal axis;

a coupling to transmit rotational movement of the drive shaft about its longitudinal axis to the pumping part, to cause the pumping part to rotate, the coupling comprising a first part which is connected to the pumping part and a second part which is connected to the drive shaft, the first part being provided with an electrically conductive material and the second part being provided with an element for generating a magnetic field, the second part being moveable relative to the first part to vary a degree of interaction between a magnetic field generated by the element and the electrically conductive material; and a fluid controlled actuator for causing the movement of the second part relative to the first part, the actuator including a piston moveable within a non-rotatable cylinder, and a biasing mechanism for biasing the second part towards the first part, such that in the event of inoperation of the actuator, the second part is urged towards the first part, so as to ensure an interaction between the magnetic field generated by the element and the electrically conductive material.

12. A pump according to claim 11 wherein the biasing mechanism is a compression spring.

13. A cooling system for an automotive engine comprising:

a pump comprising a pumping part which is mounted for rotation in a pumping chamber formed by a housing, rotation of the pumping part causing pumping of fluid;

a drive shaft rotatable about a longitudinal axis; and a coupling to transmit rotational movement of the drive shaft about its longitudinal axis to the pumping part, to cause the pumping part to rotate, the coupling comprising a first part which is connected to the pumping part and a second part which is connected to the drive shaft, the first part being provided with an electrically conductive material and the second part being provided with an element for generating a magnetic field, the second part being moveable relative to the first part to vary a degree of interaction between a magnetic field generated by the element and the electrically conductive material, the pump also comprising a fluid controlled actuator for causing the movement of the second part relative to the first part, the actuator comprising a piston moveable within a non-rotatable cylinder, and a biasing mechanism for biasing the second part towards the first part, such that in the event of inoperation of the actuator, the second part is urged towards the first part, so as to ensure an interaction between the magnetic field generated by the element and the electrically conductive material.

* * * * *